US009151106B2

(12) United States Patent
Noble, III

(10) Patent No.: US 9,151,106 B2
(45) Date of Patent: Oct. 6, 2015

(54) FIRE DOOR STOP SYSTEM

(71) Applicant: Charles A. Noble, III, Sanford, ME (US)

(72) Inventor: Charles A. Noble, III, Sanford, ME (US)

( * ) Notice: Subject to any disclaimer, the term of this patent is extended or adjusted under 35 U.S.C. 154(b) by 0 days.

(21) Appl. No.: 14/211,008

(22) Filed: Mar. 14, 2014

(65) Prior Publication Data

US 2014/0260017 A1 Sep. 18, 2014

Related U.S. Application Data

(60) Provisional application No. 61/788,542, filed on Mar. 15, 2013.

(51) Int. Cl.

| | |
|---|---|
| ***E06B 7/16*** | (2006.01) |
| ***E06B 5/16*** | (2006.01) |
| *E06B 3/88* | (2006.01) |

(52) U.S. Cl.

CPC .. *E06B 5/164* (2013.01); *E06B 3/88* (2013.01)

(58) Field of Classification Search

CPC . E04B 5/161; E04B 5/164; E04B 2003/1703; E04B 5/16; E04B 3/88

USPC ..... 52/784.11, 232, 204.1, 210–213, 800.1, 52/800.11, 802.1, 802.11, 288.1, 717.02, 52/656.3; 49/383, 462, 475.1, 400, 493.1, 49/496.1, 479.1

See application file for complete search history.

(56) References Cited

U.S. PATENT DOCUMENTS

| | | | | |
|---|---|---|---|---|
| 3,130,455 | A * | 4/1964 | Borlenghi | 49/504 |
| 3,566,541 | A * | 3/1971 | Coulter | 49/475.1 |
| 3,591,985 | A * | 7/1971 | Coppins | 49/504 |
| 4,001,974 | A * | 1/1977 | Wright | 49/489.1 |
| 4,281,481 | A * | 8/1981 | Wendt | 49/504 |
| 4,748,771 | A * | 6/1988 | Lehnert et al. | 49/399 |
| 4,888,918 | A * | 12/1989 | Green et al. | 49/501 |
| 5,203,130 | A * | 4/1993 | Freelove | 52/211 |
| 5,214,880 | A * | 6/1993 | Woodruff et al. | 49/490.1 |
| 5,230,180 | A * | 7/1993 | Tweedt et al. | 49/400 |
| 5,355,625 | A * | 10/1994 | Matsuoka | 49/400 |
| 5,669,192 | A * | 9/1997 | Opdyke et al. | 52/211 |
| 5,836,118 | A * | 11/1998 | Thornton et al. | 52/204.1 |
| 6,088,966 | A * | 7/2000 | Kenkel | 49/383 |
| 6,170,210 | B1 * | 1/2001 | Marts | 52/232 |
| 6,374,545 | B1 * | 4/2002 | Baczuk | 49/470 |
| 6,478,308 | B1 * | 11/2002 | McMillin et al. | 277/630 |
| 6,668,499 | B2 * | 12/2003 | Degelsegger | 52/204.62 |
| 6,826,877 | B1 * | 12/2004 | Stradel | 52/211 |
| 7,204,059 | B2 * | 4/2007 | Schiffmann et al. | 52/211 |
| 2004/0221527 | A1 * | 11/2004 | Sykora | 52/213 |
| 2005/0268559 | A1 * | 12/2005 | Ellingson | 49/475.1 |
| 2006/0179905 | A1 * | 8/2006 | Killins | 70/418 |
| 2007/0261312 | A1 * | 11/2007 | Kuppler | 49/470 |
| 2009/0241465 | A1 * | 10/2009 | Majors | 52/784.11 |
| 2011/0095548 | A1 * | 4/2011 | Weinraub | 292/346 |
| 2011/0283627 | A1 * | 11/2011 | Shaw | 49/478.1 |

* cited by examiner

*Primary Examiner* — Beth Stephan

(74) *Attorney, Agent, or Firm* — Lando & Anastasi, LLP

(57) ABSTRACT

A fire door stop system for retrofitting a fire door assembly so as to bring the assembly into compliance with fire safety codes. The fire door stop system has a profile strip that is attachable to a fire door frame. An edge of the profile strip extends outward from the frame in a line with a face of the soffit against which the pull edge of the fire door closes. The fire door stop system further includes, as needed, edge protectors for a wood fire door, such as a horizontal edge protector, a vertical edge protector, and a bottom-edge extender, and a latch protector.

9 Claims, 5 Drawing Sheets

FIRE DOOR STOP SYSTEM

BACKGROUND INFORMATION

1. Field of the Invention

The invention relates to fire doors. More particularly, the invention relates to a fire door stop to stop the spread of smoke, hot gases, or fire from flowing between a fire door and the door frame.

2. Discussion of the Prior Art

The National Fire Protection Association (NFPA) develops codes and standards that minimize the risk and effects of fire and other hazardous situations. NFPA 80 regulates the installation and maintenance of assemblies and devices used to protect openings in walls, floors, and ceilings and as of 2007 requires that all doors and door frames that are labeled fire doors and labeled fire door frames be inspected and tested annually. This standard is herein incorporated in its entirety by reference. NFPA 80 specifies the allowable clearances or gaps between fire door and frame and the floor. Currently, the specified clearance between door and frame is ⅛ inch, plus or minus 1/16 inch, for steel doors, and shall not exceed ⅛ inch for wood doors. The clearance between the bottom of the fire door and the floor shall be a maximum of ¾ inch.

Precise standards regulating fire doors exist to ensure that a fire door assembly, which includes a fire door and a fire door frame with door frame, functions as desired to stop the flow of fire, hot gases, and smoke. The standards require that the fire door assembly, i.e., the labeled door frame and the labeled fire door, be built to a specified size and then be installed, such that about ½ inch of the edge of the door overlaps the soffit height of the frame, which is typically ⅝ inch deep, thereby creating an overlap interface between fire door and door frame. The specified clearance between door and frame is ⅛ inch, plus/minus 1/16 inch for steel doors, and shall not exceed ⅛ inch for wood doors. Clearances are always measured from the pull face of the door. This overlap is necessary in a fire condition to keep the fire door in place and together, when a fire hose water stream is put onto the fire door, and to hold back the fire, hot gases, and smoke, and also to allow for shrinkage in wood doors, as the wood edges burn away in a fire condition.

Unfortunately, the doors and door frames are built to the minimum standards and, if the installation isn't perfect, the clearance between the edge of the labeled fire door and the labeled door frame may be excessive, such that the overlap is less than specified or that a gap exists between the edge of the door and the edge of the frame. There are an estimated 150 million fire doors installed in the US today and 80% of them fail a first-time inspection. The overwhelming majority of the failures are due to excessive clearance between door and door frame. Typically, the excessive clearance is ¼ to 5/16 inch wide, with some clearances as large as ½ inch.

Also, buildings settle over the years, increasing imperfections in the installation and contributing to the formation of an excessive clearance. The remedy is to shim the door frame to eliminate the excessive clearance, or to replace the door and frame altogether. Replacing the door and/or frame is not only costly, but may be nearly impossible. In many commercial building, including hospitals and schools, the fire door frames are embedded in concrete as the building is constructed. Even the less invasive remedy of shimming the door frame can be impossible in this case. If it is possible to shim the door, this means pulling the door from the hinge side toward the lock side, which then frequently creates an excessive clearance on the hinge side.

What is needed, therefore, is a simple, reliable means of eliminating a gap between a labeled fire door and labeled fire door frame, even when both door and frame have been built to minimum standards.

BRIEF SUMMARY OF THE INVENTION

The invention is a fire door stop system for use on steel or wood fire door assemblies. The fire door stop system according to the invention, also referred to as a "profile system," is installed on door labeled fire door frames of labeled fire door assemblies and increases the overlap between the fire door and the door frame. The profile system according to the invention corrects excessive clearances on fire door assemblies, which would otherwise fail a safety inspection and void the label on the labeled fire door assembly, and brings them into compliance with the fire safety codes.

The door stop according to the invention is a profile strip made of 16 to 20 gauge steel with a strip of intumescent sealant that is applied to the profile. The sealant expands with heat, to seal out gases, air, flame, and/or smoke. The overlap of the door with the frame ensures that the fire door is capable of withstanding the typical hose stream pressure, which presses the door against the door stop.

Wood fire doors have wood edges that burn out within minutes in a fire condition, in some cases, leaving no edge to interface with the door frame. These edges require added fire protection along the horizontal edge and/or the vertical edge of the door when clearances are excessive. The fire door stop system according to the invention includes additional profiles for protecting these edges.

A latch protector may also be provided, for use with steel or wood fire doors, to ensure that the bolt extends far enough into the striker plate to properly engage the latch.

The fire door stop system according to the invention, i.e., the fire door stop and, as needed, the edge protectors, latch protector, and the fire-door extension, guarantees proper performance of the fire door, which is an integral part of a life-safety protection system. The fire door stop system accommodates the typical business practice of manufacturing to minimum standards and imperfections in manufacturing and installation.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
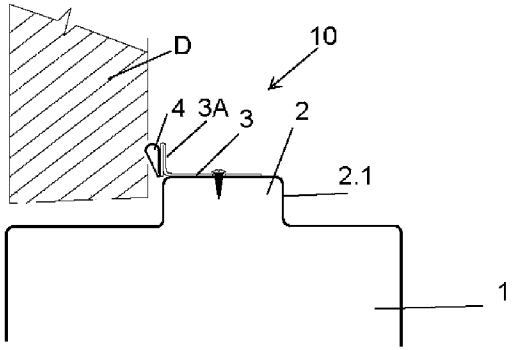
FIG. 1 is a top plan partial illustration of the fire door stop system according to the invention.

FIGS. 1-6 illustrate a fire door stop system 10 according to the invention that is used with a fire door assembly, to ensure that the assembly remains compliant with fire safety codes. A fire door assembly that is compliant includes a labeled fire door D and a labeled fire door frame 1. FIG. 1 shows a partial section of a fire door assembly, i.e., a conventional labeled fire door D and a conventional labeled fire door frame 1 with a soffit 2. The door D is closed. The soffit 2 has a standard soffit height 2.1 of ⅝ inch. As shown in the figure, there is a gap between the door D and the soffit 2. The fire door stop system 10 comprises a profile strip 3 and an intumescent sealer 4 that is mountable on the profile strip 2, to provide a seal between the fire door D and the profile strip 3. The profile strip 3 has a flange 3A that extends the soffit height of the soffit 2 out from the door frame 1, thereby providing a greater "overlap" area of the edge of the door against the soffit 2.

Figure 2:
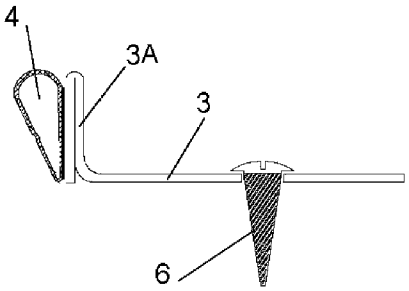
FIG. 2 illustrates details of the profile strip and intumescent sealer.
Figure 3:
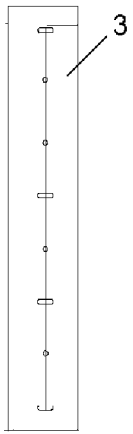
FIG. 3 is an elevation view of the profile strip.

FIGS. 2 and 3 show details of the profile strip 3. The profile strip 3 is a flat strip of steel, preferably 22 gauge steel, that is folded to create the flange 3A. Bores or dimples may be provided at intervals along the face of the strip, to facilitate fastening the strip 3 to the vertical edge of the door D. Fasteners 6 used to attached the profile strip 3 to the door D are preferably flat head Phillips screws, steel, zinc plated.

The intumescent sealer 4 is any suitable sealer, such as the intumescent fire, smoke, and draft gasket commercially available as Zero FS-488 or Loreint product number ES99.

The fire door stop system 10 is applied to areas of excessive clearance that frequently occur between the fire door D and the door frame 1, i.e., between the vertical edge of the fire door D that closes against the door frame 2 and, as needed, between the top of the fire door D and the fire door frame 2 and between the bottom of the fire door D and the finished floor. Normally, with steel fire doors, the fire door stop system 10 as described above is sufficient to ensure that the fire door assembly satisfies the fire safety code.

Wood fire doors need added edge protection, because the wood edges, if not protected, may burn out within minutes in a fire condition, leaving little interface between the fire door and the fire door frame. Steel fire doors do not need this edge protection, because steel doesn't burn out or shrink in a fire condition. For this reason, the door stop system 10 includes a horizontal edge protector 5, a vertical edge protector 9, and a bottom-edge extender 7.

Figure 4:
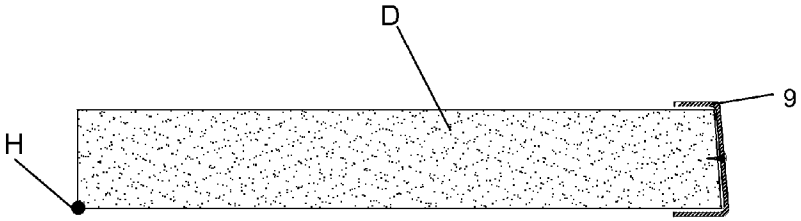
FIG. 4 is a plan view of the top edge of a door, showing a vertical edge protector attached.
Figure 5:
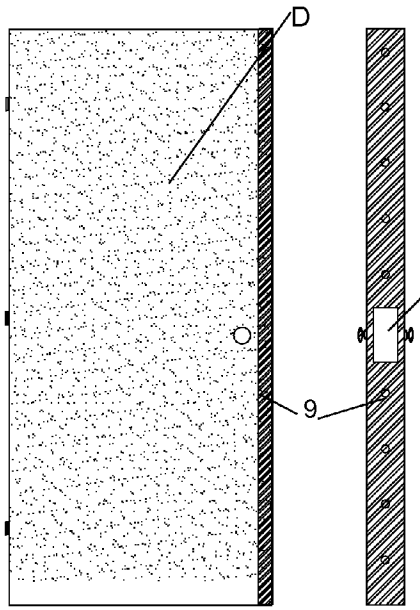
FIG. 5 is an elevation view of a front face of a door, showing the vertical edge protector attached.
Figure 6:
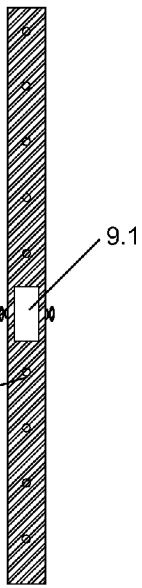
FIG. 6 is an elevation view of the pull edge of a door, showing the vertical edge protector attached.

FIGS. 4-6 illustrate a vertical edge protector 9 for the fire door D that is wrapped around the vertical edge of the door. A cut-out 9.1 is provided, to accommodate a door latch.

Figure 8:
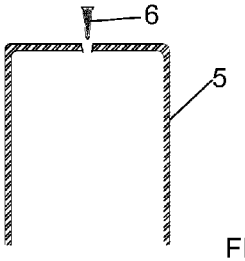
FIG. 8 illustrates details of the top edge protector.
Figure 7:
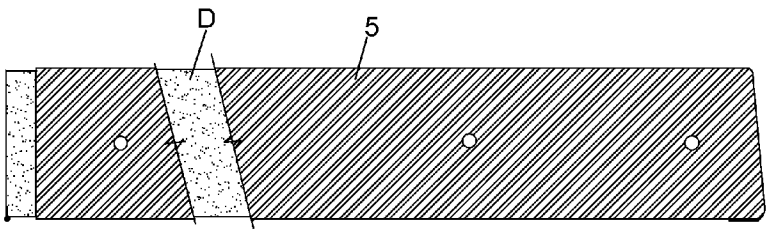
FIG. 7 illustrates a top edge protector on a door.
Figure 12:
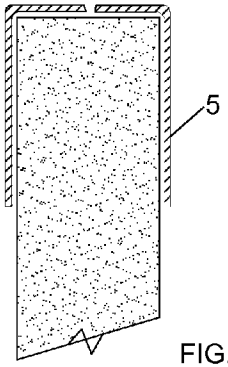
FIG. 12 is a cross-sectional view of the top portion of a door, showing the top edge protector placed over the top edge of the door.
Figure 11:
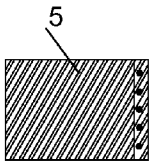
FIG. 11 illustrates a method of wrapping the top edge protector around the edge of the door.
Figure 10:
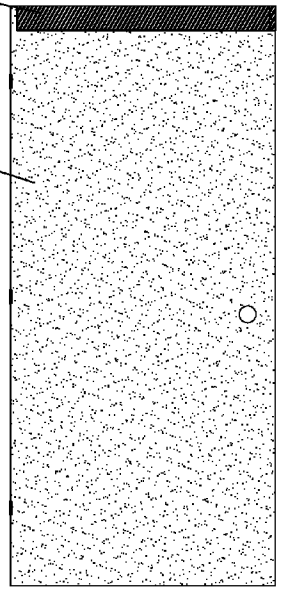
FIG. 10 illustrates the front face of a door with the top edge protector attached.
Figure 9:
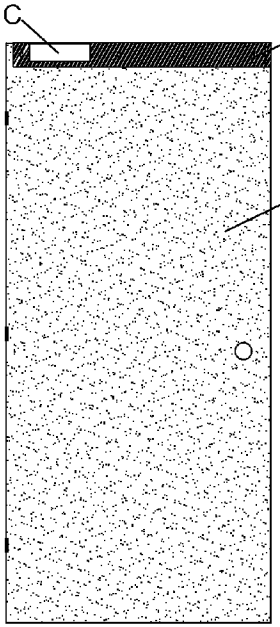
FIG. 9 illustrates the rear face of a door with the top edge protector attached.
Figure 14:
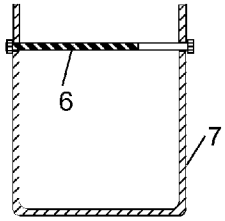
FIG. 14 illustrates details of the bottom extension.
Figure 15:
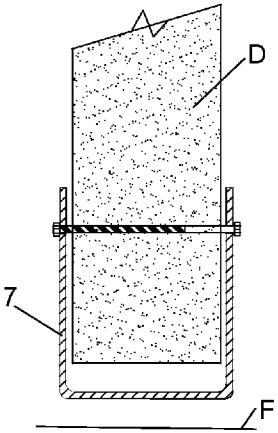
FIG. 15 shows the bottom extension fastened to the bottom edge of a door.

FIGS. 7-12 show the horizontal edge protector 5. This protector is made of the same material as the profile strip 3 and may be cut to fit the edge of the door D, whereby care must be taken to be sure there are no sharp or protruding edges. This optional edge protectors 5 is not needed for fire-rated steel or steel-composite doors. The horizontal edge protector 5 is a profile that is wrapped around the top edge of the door D. FIG. 8 illustrates details of the protector 5 with fastener 6 and FIGS. 9-11 illustrate how the edge protector 5 is fitted on the door.

Figure 18:
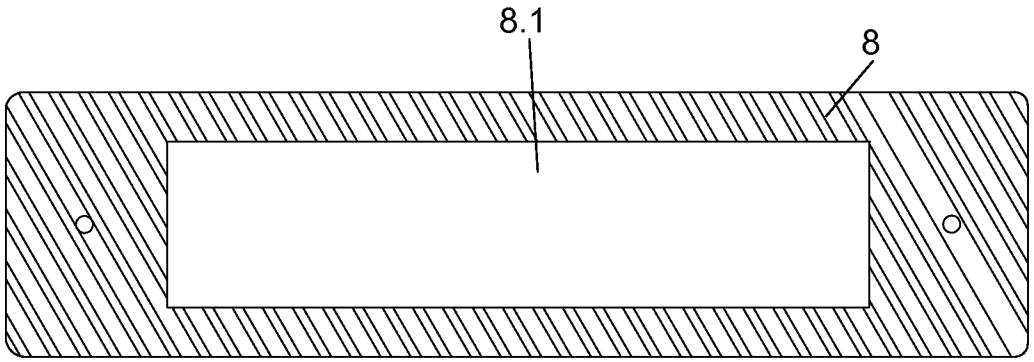
FIG. 18 illustrates a latch protector that is used with a fire door.

FIG. 18 illustrates a latch protector 8, which may be used on wood fire doors and steel fire doors, as need. The bolt for the latch on the door lock has to extend into the striker plate at least ½ inch for proper latch engagement and in order to be compliant with the fire safety code. The latch protector 8 is a plate that is mounted on the closing edge of the door frame 1 behind the striker plate, which moves the striker plate out closer to the edge of the door. This, of course, reduces the clearance between the striker plate and the door and allows the latch to penetrate farther into the striker plate, bringing the door into compliance with the safety code.

Figure 13:
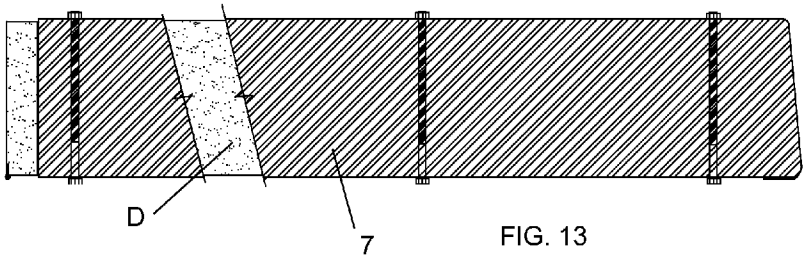
FIG. 13 is a plan view of the bottom edge of a door, with the bottom extension attached to the door.
Figure 17:
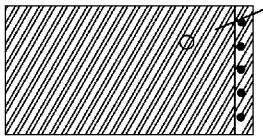
FIG. 17 illustrates a method of wrapping the bottom extension around the bottom edge of the door.
Figure 16:
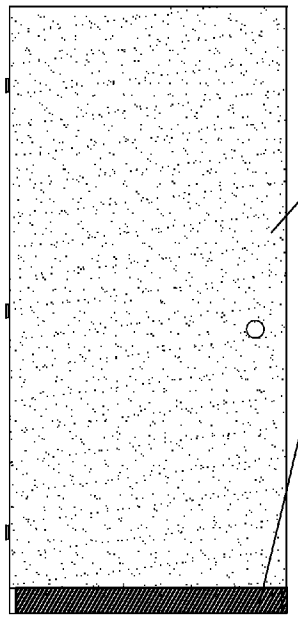
FIG. 16 is a plan elevation view of the front face of a door, showing the bottom extension attached.

FIGS. 13-17 illustrate the bottom-edge extender 7 that may be used in conjunction with the fire door stop system 10 according to the invention. According to the fire safety code, the bottom edge of a fire door has to be with a certain distance of the floor, i.e., within ¾ inch or closer to the finished floor. Often, the gap between the bottom of the door and the floor is greater than the distance specified by the safety code. This bottom-edge extender 7 may be attached to the bottom edge of a finished fire door and so mounted on the door, that the lower edge of the extender is the proper distance from the finished floor, thereby bringing the labeled fire door into compliance with the code. The extender 7 is so constructed, that doors with a clearance of up to two inches may be extended downward to meet the requirement and be brought into compliance with the fire safety code. FIG. 13 is a plan view of the bottom of a door, with the bottom extension 7 attached and FIG. 15 particularly shows how the bottom extension 7 is used to reduce the gap between the bottom edge of the door D and the floor F.

The door stop system 10 according to the invention is constructed to match the rating of the fire door assembly up to three (3) hours and does not increase or decrease the rating of the fire door assembly.

It is understood that the embodiments described herein are merely illustrative of the present invention. Variations in the construction of the fire door stop system may be contemplated by one skilled in the art without limiting the intended scope of the invention herein disclosed.

What is claimed is:

1. A fire door stop system used with a fire door assembly that includes a fire door and a fire door frame having a soffit that forms an overlap surface between the fire door and the fire door frame, the fire door stop system comprising:

a profile strip that is configured to be fastenable to the soffit; and a seal consisting of an intumescent material to form an intumescent seal between the profile strip and the soffit;

wherein the profile strip has a flange that, when fastened to the soffit, extends outward from the soffit, so as to form an extended overlap surface between the fire door and the fire door frame, the flange having a face surface that faces the fire door; and wherein the seal is affixed to the face surface of the flange so as to form the intumescent seal between the flange and the soffit under non-fire conditions when the fire door is closed.

2. The fire door stop system of claim 1, wherein the soffit has a fire door stop surface against which the fire door closes;

wherein the profile strip is a flat strip; and wherein the flange is formed by folding an edge of the profile strip.

3. The fire door stop system of claim 2, wherein the profile strip is constructed of 22 gauge steel.

4. The fire door stop system of claim 1, further comprising a horizontal edge protector, wherein the fire door has a front face, a rear face, and a horizontal edge face at a top and at a bottom of the fire door, and wherein the horizontal edge protector has a three-sided channel shape that fits over the horizontal edge face and extends a distance onto the front face and the rear face, so as to protect the horizontal edge face at the top and/or at the bottom of the fire door.

5. The fire door stop system of claim 4, wherein the horizontal edge protector is a bottom-edge extension that is fastenable to a bottom edge of the fire door and is adjustable in its placement on the bottom edge of the fire door, so as to reduce a gap between the bottom edge of the fire door and a finished floor surface.

6. The fire door stop system of claim 1, further comprising a latch protector that is a steel plate with a cutout dimensioned to accommodate dimensions of a striker plate opening that is provided on a striker plate that is mountable on the fire door frame, wherein the latch protector is mountable between the striker plate and the fire door frame.

7. The fire door stop system of claim 1, further comprising a vertical edge protector, wherein the fire door has a front face, a rear face, and a vertical edge face along each side of the fire door, and wherein the vertical edge protector is wrapped around the vertical edge face of at least one side of the fire door.

8. The fire door stop system of claim 1, wherein the profile strip is configured to remedy non-compliant fire doors and fire door frames having clearances greater than 3/16" for steel doors and greater than 1/8" for wood doors.

9. The fire door stop system of claim 1, wherein the profile strip is configured to remedy non-compliant fire doors and fire door frames having clearances up to 1/2" for steel doors and up to 3/8" for wood doors.

* * * * *